US006578320B1

(12) United States Patent
Munton

(10) Patent No.: US 6,578,320 B1
(45) Date of Patent: Jun. 17, 2003

(54) SLIDING DOOR CLOSER

(76) Inventor: David John Munton, 3 Bramton Court, Mulgrave, Victoria (AU), 3170

( * ) Notice: Subject to any disclaimer, the term of this patent is extended or adjusted under 35 U.S.C. 154(b) by 0 days.

(21) Appl. No.: 10/121,973

(22) Filed: Apr. 12, 2002

(51) Int. Cl.[7] ..... E05D 15/06
(52) U.S. Cl. ..... 49/404; 49/363
(58) Field of Search ..... 49/404, 360, 363; 16/71, 72, 73, 80, 84

(56) References Cited

U.S. PATENT DOCUMENTS

| | | | | | |
|---|---|---|---|---|---|
| 2,573,160 | A | * | 10/1951 | Norman | 49/404 |
| 3,561,161 | A | * | 2/1971 | Green | 49/404 |
| 3,887,962 | A | * | 6/1975 | Mills | 16/72 |
| 4,471,575 | A | * | 9/1984 | Stout | 49/404 |
| 5,235,723 | A | * | 8/1993 | Wallis | 16/71 |
| 5,622,007 | A | * | 4/1997 | Archer | 49/404 |

FOREIGN PATENT DOCUMENTS

| | | |
|---|---|---|
| AU | 673232 | 10/1994 |

* cited by examiner

*Primary Examiner*—Jerry Redman
(74) *Attorney, Agent, or Firm*—Volpe and Koenig, PC

(57) ABSTRACT

A self-closing sliding door assembly comprising, a doorway (2) in a wall (4), a substantially planar door (6) mounted for slidable movement with respect to the doorway to open and close the doorway, a closer (12) mounted on one of the door (6) and wall (4) having a drive shaft (14) rotatable about an axis, and an arm assembly having first and second arm members (16, 18) connected to each other by a first pivotal join (20), the first arm member being connected to the drive shaft and the second arm member being connected by a second pivotal join (22) to the other of the one of the door and wall, wherein the drive shaft is arranged to urge the first arm member to pivot about the axis whereby the arm assembly urges the door to close the doorway.

6 Claims, 3 Drawing Sheets

SLIDING DOOR CLOSER

FIELD OF THE INVENTION

This invention relates to a self-closing sliding door assembly.

BACKGROUND OF THE INVENTION

The use of self-closing hydraulic door closer assemblies for pivotably mounted doors has been common practice in the industry for many years. Such hydraulic door closer assemblies generally include hydraulic closer means which are mounted on the frame of the doorway and an arm which is pivotably secured to the body of the closer means at one end and to the door at its other end. The hydraulic mechanisms provided in the closer body serve to rotate the arm and hence urge the door back to its original closed position after it has been opened.

While such hydraulic door closer mechanisms have proved to be very successful for closing swinging or pivotably mounted doors, the nature of their mode of operation has in the past made them unsuitable for use with sliding doors. Nevertheless, given the relatively low cost of such hydraulic door closing mechanisms, it is preferable that they be adapted to operate to close sliding doors without requiring a completely new type of closer assembly mechanism.

With this object in mind, Australian patent 673232 to the current applicant discloses a self-closing sliding door assembly which can operate using readily available hydraulic door closing mechanisms. However, it suffers from the disadvantage that the force exerted by the door closing mechanism on the sliding doors varies dramatically with the degree to which the door has been opened. This is because it operates via an arm which follows a track provided on a door. As the arm moves along the track, the angle the arm makes with respect to the door closer changes quite substantially and as a result the amount of force exerted by the door closer varies substantially with changing angle.

There is therefore a need for a self-closing sliding door assembly which operates on a principle requiring less change of angle than that required for the operation of the door closer assembly described in patent 673232.

DISCLOSURE OF THE INVENTION

The invention provides a self-closing sliding door assembly comprising, a doorway in a wall, a substantially planar door mounted for slidable movement with respect to the doorway to open and close the doorway, closer means mounted on one of the door and wall having a drive shaft rotatable about an axis, and an arm assembly having first and second arm members connected to each other by a first pivotal join, the first arm member being connected to the drive shaft and the second arm member being connected by a second pivotal join to the other of the one of the door and wall, wherein the drive shaft is arranged to urge the first arm member to pivot about the axis whereby the arm assembly urges the door to close the doorway.

Suitably, the angle subtended between a first straight line drawn between the axis and the first pivotable join and a second straight line drawn between the first pivotable join and the second pivotable join is between 10° and 50° when the doorway is closed. More suitably the angle should be between 15° and 35°.

The wall may comprise a frame for the doorway. The closer means may comprise a hydraulic door closer. The hydraulic door closer may be arranged to pivot the first arm in a plane parallel to the plane of the door. The closer means may be mounted on the doorway frame.

For aesthetic reasons, it is preferred that both of the arm members may be directed to extend generally parallel to the horizontal when the door is closed. The second arm member may comprise a first portion extending substantially horizontally from the first pivotable join and a second portion extending from the opposite end of the horizontal portion substantially vertically to the second pivotal connection with the door when the door is in a closed position.

When the door is opened to its maximum extent, it is preferred that the combined horizontal span of both the first and second arm members in this position be at least two thirds of the width of the doorway. Suitably the span should be equal to or greater than the door way to ensure that the doorway is completely unobstructed by the door.

Preferred aspects of the invention will be described with reference to the accompanying drawings.

Elements identified by numerals in the accompanying drawings are listed in the following Integer List.

Integer List

| | |
|---|---|
| 1 | Self-closing sliding door assembly |
| 2 | Doorway |
| 4 | Doorway frame |
| 6 | Door |
| 7 | Door frame |
| 8 | Glass pane/wall |
| 10 | Glass pane/door |
| 12 | Door closer |
| 14 | Shaft |
| 15 | Screw |
| 16 | First arm |
| 18 | Second arm |
| 19 | Horizontal portion |
| 20 | Pivot join |
| 21 | Vertical leg |
| 22 | Pivot join |
| 23 | Arrow |
| 24 | Rivet |
| 25 | Washer |
| 27 | Washer |
| 30 | Bolt |
| 31 | Nut |

Referring to FIGS. 1 to 5 of the accompanying drawings the self-closing sliding door assembly designated 1, includes a doorway 2 surrounded by a doorway frame 4.

Figure 1:
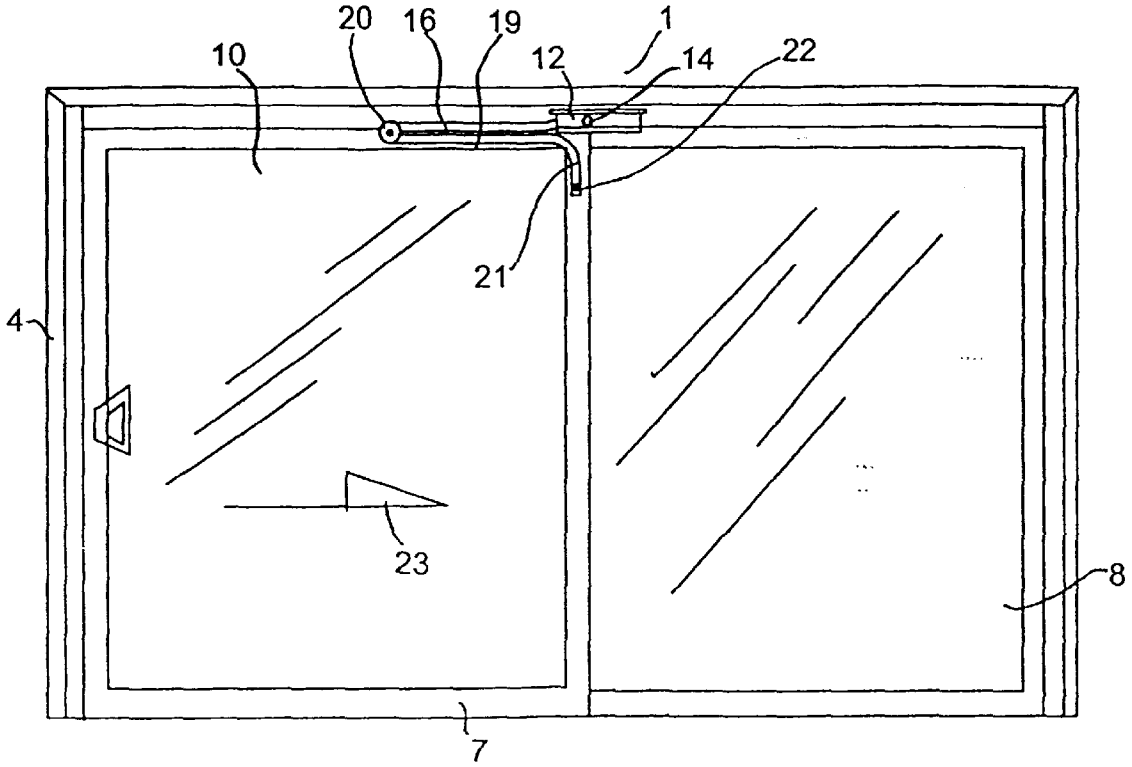
FIG. 1 an elevational view of a self-closing sliding door assembly according to the invention with the door closed.
Figure 2:
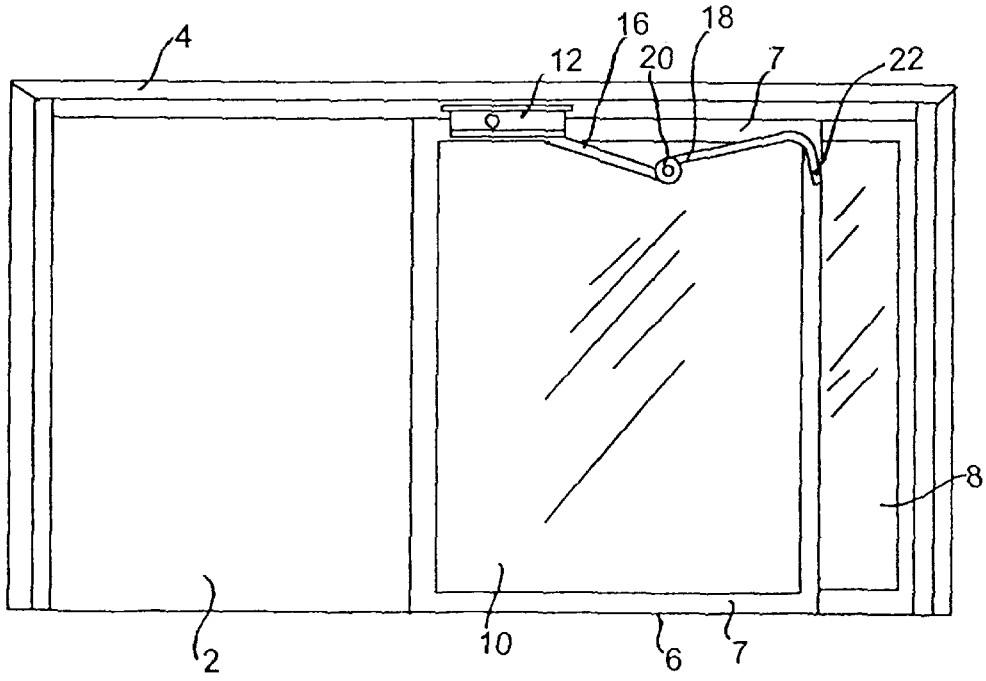
FIG. 2 shows an elevational view of the self-sliding door assembly of FIG. 1 with the door open.
Figure 3:
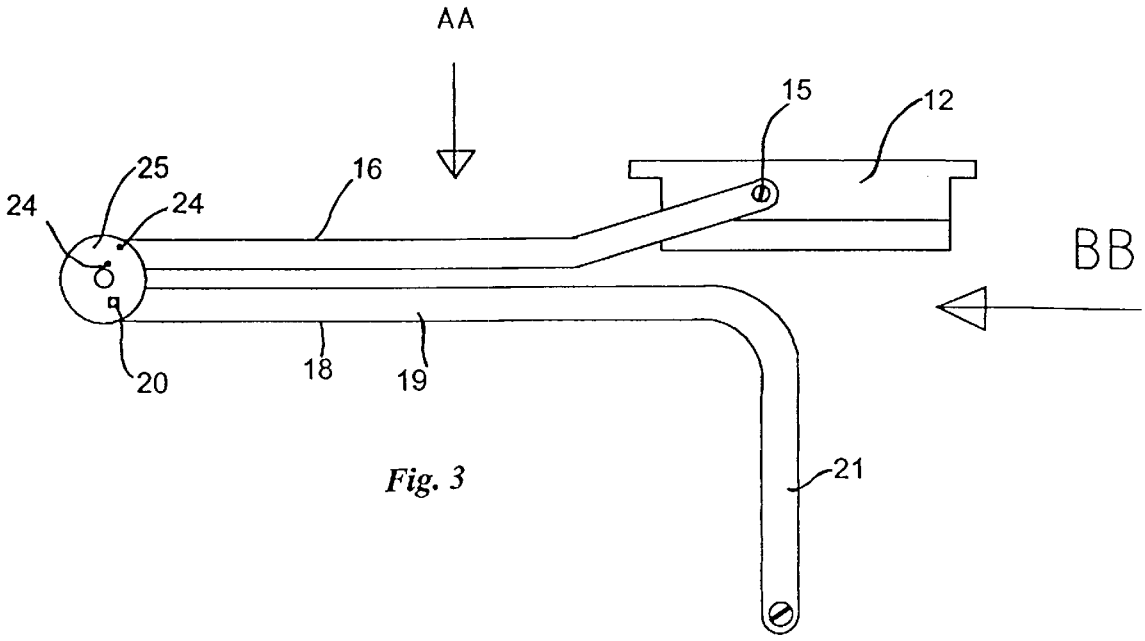
FIG. 3 shows an elevational view of the door closer assembly of FIG. 1 rotated through 180°.
Figure 4:
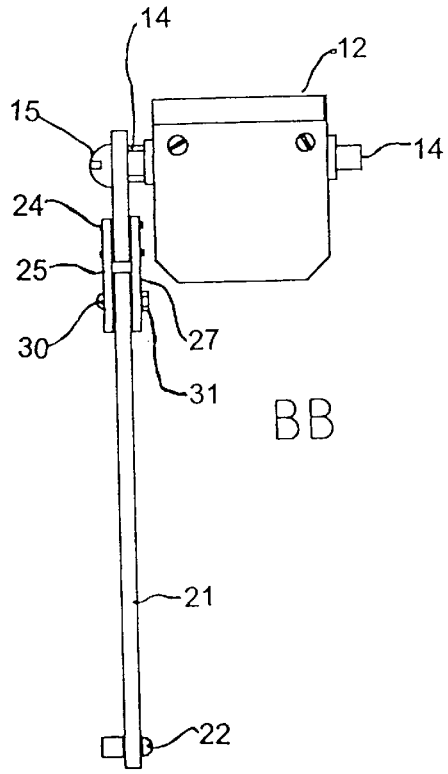
FIG. 4 shows an end on view of the door closer assembly of FIG. 3 taken from the direction of arrow BB.
Figure 5:
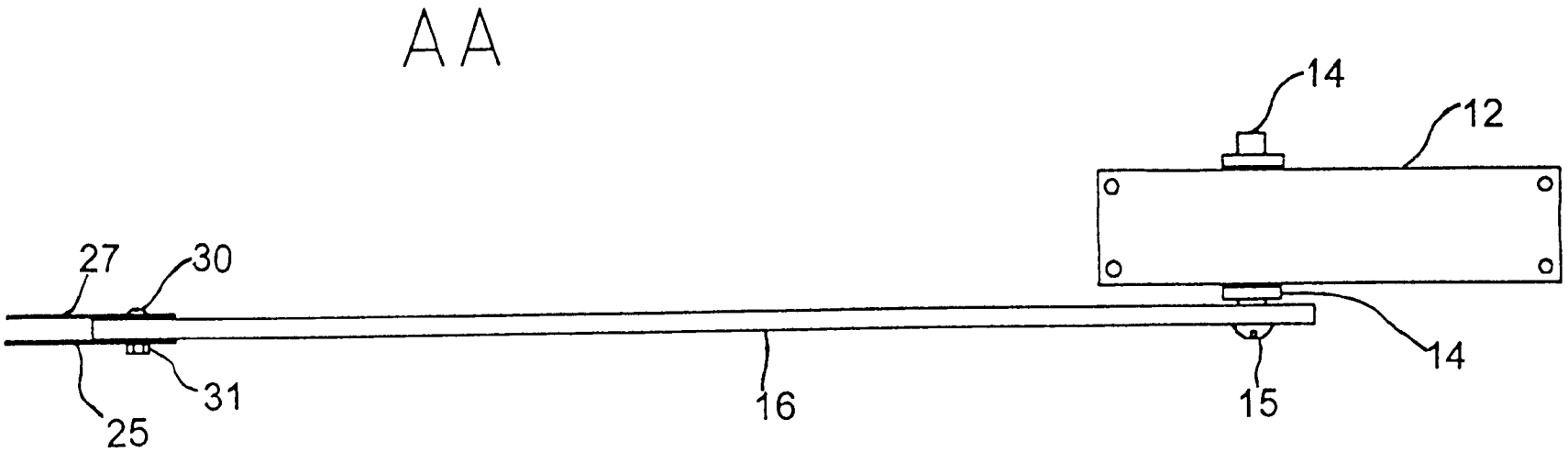
FIG. 5 shows a plan view of the door closer assembly of FIG. 3 taken from the direction of arrow AA.

A door 6, which may typically include a door frame 7 and a glass pane 10 or other panel, is mounted for sliding movement with respect to the doorway to open and close the door ie. the door which is shown as being closed in FIG. 1 can be moved in the direction of arrow 23 to open the door as is shown in FIG. 2.

The doorway frame may extend to surround a further panel such as a glass panel 8 which may form a fixed part of a wall in which the doorway is located or may itself be moveable as well.

A door closer 12 is secured to the upper part of the doorway frame above the door. The door closer is a conventional hydraulic door closer such is commonly available from manufacturers such as Ryobi. It includes a shaft 14 extending through the body of the door closer. The shaft is rotatable about its axis running perpendicular to the plane of the page of the drawing. It has a square end which fits into a complementary square socket hole on the first arm 16. It is secured to one end of the first arm 16 by a screw 15 and is arranged so that rotational torque applied through the shaft 14 urges the arm to pivot about the axis of the shaft in a plane substantially parallel to the plane of the door 6.

The other end of the first arm is joined by means of a pivotal join 20 to one end of a second arm 18.

The pivotal join comprises washers 25 and 27 rigidly connected to the first arm by rivets 24 and pivotally connected to the second arm by the bolt and nut 30 and 31.

The second arm includes a horizontal portion 19 and a vertical leg 21. The end of the vertical leg 21 is joined by the pivot join 22 to the door frame 7.

When the door is closed as is shown in FIG. 1, a bent portion of the first arm is connected to the shaft and part of the first arm extends substantially horizontally. A portion of the second arm also extends substantially horizontally. The parallel sections of the horizontal portions of the first and second arm are provided largely for aesthetic reasons. Furthermore, the angle subtended between two straight lines extending from the axis of the shaft 14 to the pivot join 20 and then to the pivot join 22 is about 20° when the door is closed. The choice of angle has a substantial effect on the amount of force exerted by the door closer to close the door. It has been found that the variation of force exerted by the door closer over the various positions between an open and closed door can be substantially reduced by having an assembly of two arms arranged in the manner illustrated in the drawings.

It is to be understood that the word comprising as used throughout the specification is to be interpreted in its inclusive form ie. use of the word comprising does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A self-closing sliding door assembly comprising, a doorway in a wall, a substantially planar door mounted for slidable movement with respect to the doorway to open and close the doorway, closer means mounted on one of the door and the wall and having a body and a drive shaft extending from the body in a direction substantially perpendicular to the plane of the door, the drive shaft being rotatable about a lengthwise axis thereof, and an arm assembly having first and second arm members connected to each other by a first pivotal join, the first arm member being connected to the drive shaft and extending generally perpendicular to the lengthwise axis of the drive shaft and the second arm member being connected by a second pivotal join to the other of the one of the door and the wall, wherein the drive shaft is arranged to urge the first arm member to pivot about the lengthwise axis whereby the arm assembly urges the door to close the doorway.

2. A self-closing sliding door assembly according to claim 1 wherein the angle subtended between a first straight line drawn between the axis and first pivotal join and a second straight line drawn between the first pivotal join and the second pivotal join is between 10° and 50° when the doorway is closed.

3. A self-closing sliding door assembly according to claim 2 wherein the angle is between 15° and 35°.

4. A self-closing sliding door assembly according to claim 1 wherein the wall comprises a frame for the doorway, the closer means comprises a hydraulic door closer which is arranged to pivot the first arm in a plane parallel to the plane of the door and the closer means is mounted on the doorway frame.

5. A self-closing sliding sliding door assembly according to claim 1 wherein the second arm member comprises a first portion extending substantially horizontally from the pivotal connection between the first and second arm members to a second portion which extends substantially vertically to the pivotal connection with the door when the door is in a position closing the opening.

6. A self-closing sliding door assembly according to claim 1 wherein the combined span of the first and second arm members is at least two thirds of the width of the doorway.

* * * * *